United States Patent [19]

Biller

[11] 4,099,402

[45] Jul. 11, 1978

[54] STRETCH REDUCING OF HOLLOW STOCK

[75] Inventor: Horst Biller, Kettwig, Fed. Rep. of Germany

[73] Assignee: Mannesmannrohren-Werke, A.G., Dusseldorf, Fed. Rep. of Germany

[21] Appl. No.: 697,976

[22] Filed: Jun. 21, 1976

[30] Foreign Application Priority Data

Jun. 25, 1975 [DE] Fed. Rep. of Germany ..... 2528883

[51] Int. Cl.[2] ..... B21B 17/14

[52] U.S. Cl. ..... 72/234

[58] Field of Search ..... 72/234, 235, 226, 224, 72/368, 367

[56] References Cited

U.S. PATENT DOCUMENTS

| | | | |
|---|---|---|---|
| 2,041,937 | 5/1936 | Korbuly | 72/235 X |
| 3,754,425 | 8/1973 | Bindernagel et al. | 72/234 |

*Primary Examiner*—Milton S. Mehr

*Attorney, Agent, or Firm*—Ralf H. Siegemund

[57] ABSTRACT

A multistand, continuous stretch reducing mill is designed so that for the major reduction passes the largest to smallest diameter ratio changes by less than 0.4% from pass to pass and the squeeze length differential remains below 1.15 times the square root of the average logarithmic reduction (in millimeters) of the outer diameter of each pass. This way, polygonal inner contour and cracks in the pipe adjacent a roll gap is avoided.

2 Claims, 7 Drawing Figures

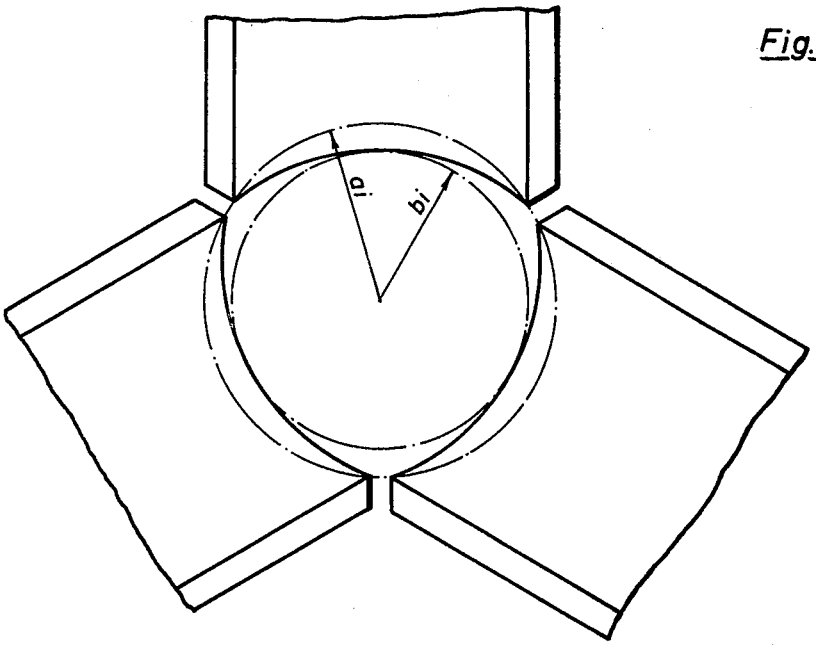
Fig. 1
Fig. 2a
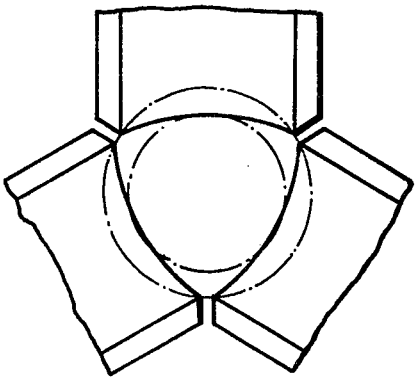
Fig. 2b
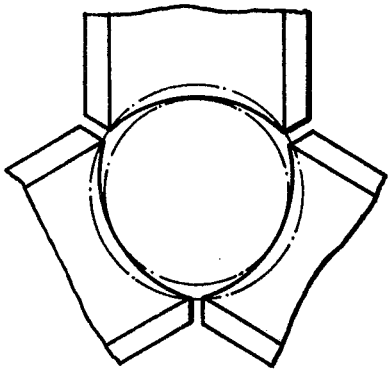

STRETCH REDUCING OF HOLLOW STOCK

BACKGROUND OF THE INVENTION

The present invention relates to stretch reducing pipes by means of a multistand, three-rolls-per-stand, stretch reducing rolling mill, particularly for avoiding the formation of a polygonal internal cross-section during stretch reducing of the pipes.

The formation of a polygonal inner cross-section during stretch-reducing rolling of pipes has been avoided by a staggered arrangement of the sets of rolls around the rolling axis so that the discontinuities resulting from the design are not located in common planes (see e.g. German Pat. No. 675,180). However, the rolls are very difficult to drive in such an arrangement and their exchange is cumbersome so that this particular proposal is not an economical one.

Another proposal (printed patent application No. S 25 445) has been made according to which groups of stands are provided which are phase shifted by 45° in a two-roll mill or by 30° in a three-roll mill. However, the same as regards economics can be said also here. Nevertheless, it has been recognized that a polygon with more sides than four (in the case of a two-roll mill) or even with more sides than six (in the case of a three-roll mill) is still an improvement and a better approximation of a circle.

In accordance with German Pat. No. 940,524, it has been suggested to prevent the formation of internal polygons by using rolls having a curvature of their respective grooves which have an asymmetric disposition to the center plane of the rolls.

The mill uses such asymmetrically designed rolls together with symmetric ones. Such an arrangement, however, has the disadvantage that the stands having rolls with asymmetrically designed grooves tend to rotate the pipe while the stands with symmetric rolls tend to prevent such a rotation. Also the difference in diameter of the rolls is larger for the asymmetric than for the symmetric configuration. It follows from the latter that the stand with asymmetric grooves of its rolls experiences larger slippage between pipe and rolls, and the latter wear more rapidly. Also, the use of two types of rolls is not economical from the standpoint of inventory. Moreover, the losses upon cutting two different types of grooves will be larger than in the case of using exclusively one type of grooves into the rolls.

Other proposals for avoiding the formation of polygons refer to rotating the pipe during stretch reducing. The German Pat. No. 675,180 and petty Pat. No. 1,807,019, disclose skewed rolls for that purpose; German Pat. No. 1,059,865 proposes asymmetric groove shapes but arranged in the same sense as far as asymmetry is concerned.

However, any turning tends to damage the surface particularly of large pipes or other hollow stock. Also, it is difficult to properly guide the rotating pipe as it leaves the mill. A skewed position requires, of course, rather complicated constructions of the mill while asymmetrically contoured rolls wear more rapidly because the differences in diameter are larger.

Still other proposals for avoiding the formation of polygons use symmetrically contoured rolls and one selects the reduction from stand to stand so that the squeezed surface in each instance is a rectangle. This, however, has the following disadvantage.

The ratio of the large design radius $a_i$ to the small design radius $b_i$ alternates between large and small values for the usual reduction from stand to stand. Thus, the contour alternates between somewhat oval (large ratio) contour and almost round (small ratio) contour. Consequently, the material experiences alternating bending at the roll gap which tends to form cracks and hair seams.

DESCRIPTION OF THE INVENTION

It is an object of the present invention to provide a new and improved method for stretch reducing rolling mills which avoids alternating bending forces at the roll gaps while the contact surface area of squeezing by engagement with the rolled stock, are rectangular as much as possible.

It is a particular object of the present invention to improve contouring of the rolls of a multistand stretch reducing mill, the rolls being cut as to their grooved contour by suitable, known cutting tools.

In accordance with the present invention, it is suggested to use a regular multistand rolling mill for stretch reducing hollow stock in steps, but the roll design particularly as to contour of the grooves, is to be modified as follows.

Stretch reducing in one of the more forwardly positioned stands, preferably the third stand, is provided so that the ratio $\alpha = a_i/b_i$ as between largest ($a_i$) and smallest ($b_i$) groove defining dimensions as related to the roll axis in the stands following that one stand, and from stand to stand thereafter for most of the mill, does not change by more than 0.4% and to provide for a difference (e.g. measured in millimeters) between largest and smallest squeezed length for each of said stands following said percentage rule for the reduction, to be smaller than 1.15 times the square root of the mean (average) logarithmic reduction in outer diameter, also in millimeters, as provided by these stands.

For specific calculation of that quantity in general see "Archiv fur das Eisenhuttenwesen", 41st year, Vol. 11-Nov. 1970, pages 1047 et seq.

These two conditions do not apply for those stands which are located in front of the particular one which begins the series to which the rules are applied. Also, the rules do not apply to the round finishing stands at the end.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a schematic view of a single stretch reducing rolling stand showing relevant terms;

FIGS. 2*a* and 2*b* are similar illustrations but are used to illustrate prior art practice;

Proceeding now to the detailed description of the drawings, FIG. 1 shows three grooved rolls in a stand for stretch reducing pipes; therein $a_i$ denotes the largest radius and $b_i$ the smallest one of the groove in relation to the axis of rolling. These radius $a_i$ and $b_i$ are the principle dimensions which define the contour of roll design. The ratio $\alpha$ referred to above is the ratio $a_i/b_i$, whereby the subscript $i$ refers to the $i$-th stand.

FIG. 2*a* shows a particular stand for a relatively large ratio $\alpha_i$ and FIG. 2*b* shows a stand in which that ratio is relatively small. The overall contour as per FIG. 2*a* is quite oval but as per FIG. 2*b*, the contour is almost round. The prior art was using, for example, rolls in which stands as per FIG. 2*a* alternated with those as per FIG. 2*b*. It was found that bending of the material adjacent the gap between any two rolls in a stand alternates from stand to stand on account of this design difference and that leads readily to the formation of cracks etc.

Figure 3:
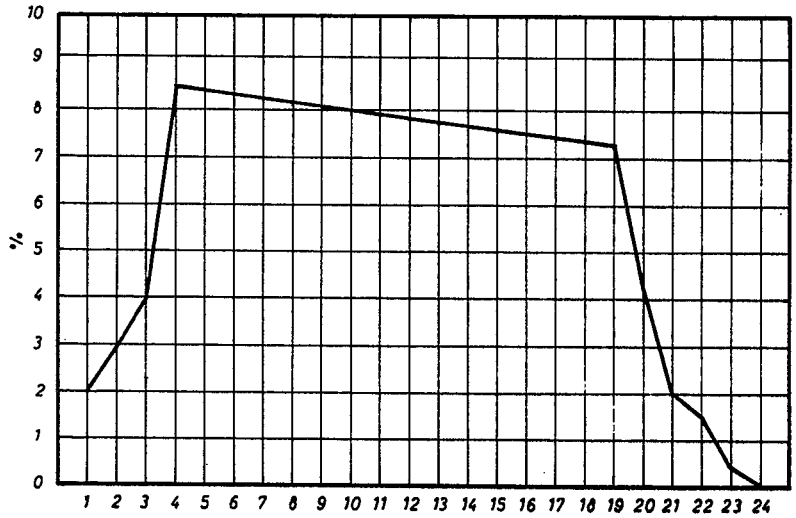
FIG. 3 is a diagram in which relative reduction from stand to stand is plotted, the abscissa identifies roll stands by number in the sequence of pipe reduction.

In accordance with the invention, it is now proposed to proceed as follows. As a preparatory step, one provides for a conventional scheme of roll contours in a multistand mill as shown in FIG. 3. The figure shows particularly a gradual increase in stretch reduction from stand 1 to 2, to 3, followed by a steep jump in stand 4, and gradual declining of the reduction up to stand 19, followed by rapid declining of the reduction towards the end. Such a stand assembly would require a distribution in the ratios $\alpha_i$ as plotted in FIG. 5.

Figure 5:
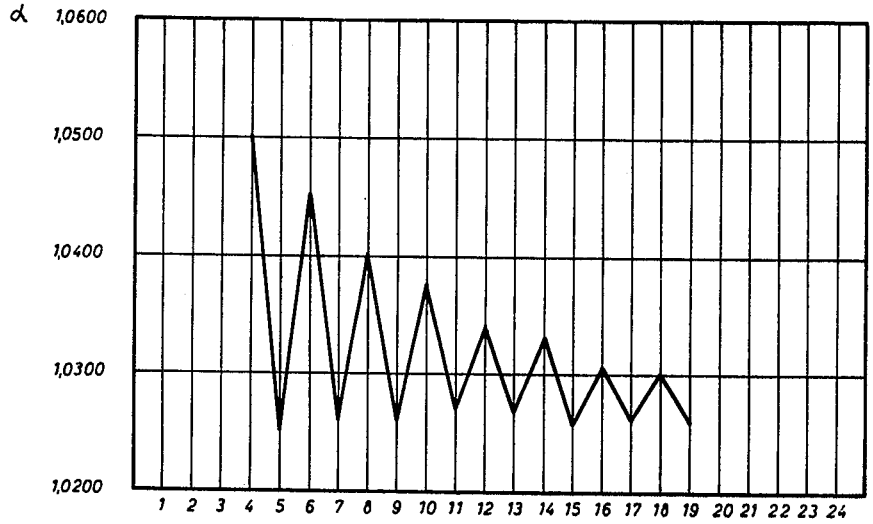
FIG. 5 is a diagram in which the ratio $\alpha$ is plotted for the several stands, there ratios have validity for the unmodified reduction diagram as per FIG. 3.

The rolls calculated and prepared in the raw as per the scheme of FIGS. 3 and 5 are now modified as follows. The diameter of the groove cutting tool is modified (hypothetically) for each stand in steps 1/1000 mm until the difference between largest and smallest value for the squeezed contact length in each of the stands from number 4 to number 19 is not larger than 1.15 times the square root of the mean logarithmic reduction in outer diameter in the entire series of stands 4 to 19. The starting point of operation for the cutting tool is a diameter which is the same of $a_i$ and $b_i$ for the particular $i$-th stand.

After having applied these steps to the stands 4 to 19 one tests whether or not the rule is fulfilled that the ratio $\alpha$ varies only by 0.4% from stand to stand. Usually, this is not the case at that point.

Next, the reduction of one of the first stands is modified, preferably in steps of 1/1000 mm, and the step of hypothetical cutting is repeated followed by testing whether the condition concerning the changes in the ratios $\alpha$ is satisfied.

The method is completed in that iterative fashion until stands 4 to 19 meet the condition concerning the changes in values for $\alpha$ as well as the condition concerning the squeeze length differential. The finishing stands 20 to 24 are excluded from the variations.

Figure 4:
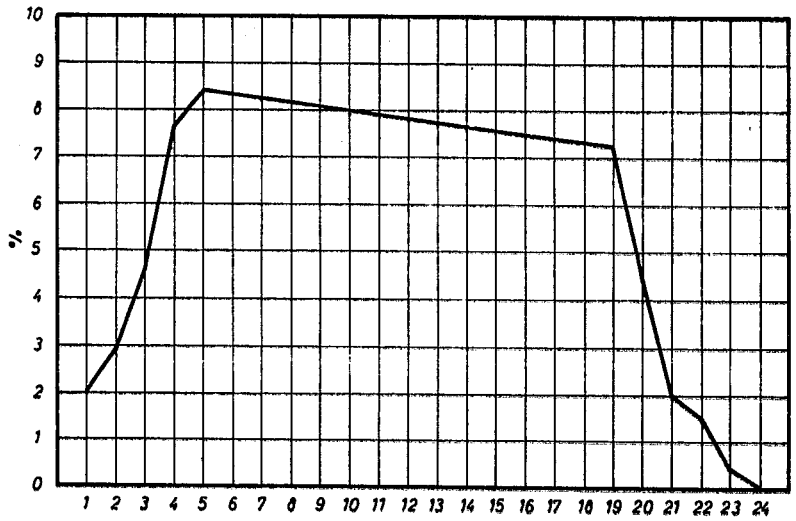
FIG. 4 is a diagram similar to FIG. 3 but showing the necessary modification as per the invention.
Figure 6:
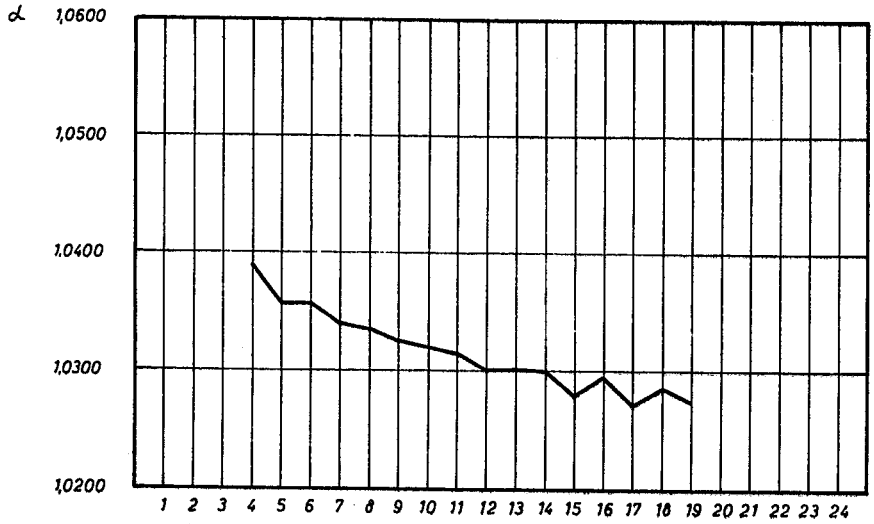
FIG. 6 is a diagram similar to FIG. 5, showing the ratio $\alpha$ as per the invention.

FIG. 4 illustrates the modified pattern of reduction from stand to stand, and the ratios $\alpha$ which result from the iterative process are shown in FIG. 6.

The thus modified multistand mill is now used for stretch reducing hollow stock whereby the contour of the inner surface of the stock remains round and alternate bending at the gap zones in each stand is avoided to a substantial degree.

The invention is not limited to the embodiments described above but all changes and modifications thereof not constituting departures from the spirit and scope of the invention are intended to be included.

I claim:

1. Method of stretch reducing pipes in a multistand rolling mill each stand having three grooved rolls said groove being oval in configuration and having a largest radius $a$ relative to the rolling axis and a smallest radius $b$ relative to that axis, the improvement comprising, providing those stands which cause a relatively large stretch reduction with a contour of the grooves of its rolls so that the ratio $a/b$ from stand to stand varies by less than 0.4%, and the difference between largest and smallest contact squeezed length in each of said stands and by each roll therein does not exceed, in millimeters, 1.15 times the square root of the average logarithmic reduction in outer diameter by said stands.

2. Method of stretch reducing pipes in a multiple stand rolling mill, comprising the steps of:

using three grooved rolls per stand with largest radius $a$ and smallest radius $b$ of each groove relative to a roll axis, whereby a ratio $a/b$ from stand to stand for the major reduction passes changes by less than 0.4% and the difference between the largest and smallest values for the contact squeezed length in each pass remains below a particular value.

* * * * *